United States Patent [19]

Corlett

[11] Patent Number: 4,832,633

[45] Date of Patent: May 23, 1989

[54] MARINE PROPULSION SYSTEM

[75] Inventor: Ewan C. B. Corlett, Port'e Vullen, Isle of Man

[73] Assignee: Hydronic, Ltd., Isle of Man

[21] Appl. No.: 265,274

[22] Filed: Oct. 25, 1988

Related U.S. Application Data

[63] Continuation of Ser. No. 13,190, Feb. 9, 1987, abandoned, which is a continuation of Ser. No. 891,064, Jul. 31, 1986, abandoned, which is a continuation of Ser. No. 771,166, Sep. 3, 1985, abandoned, which is a continuation of Ser. No. 595,609, Apr. 2, 1984, abandoned, which is a continuation of Ser. No. 498,862, May 27, 1983, abandoned, which is a continuation of Ser. No. 963,770, Nov. 27, 1978, abandoned.

[30] Foreign Application Priority Data

Nov. 30, 1977 [GB] United Kingdom ..... 49930/77

[51] Int. Cl.[4] ..... B63H 1/16

[52] U.S. Cl. ..... 440/67; 416/190

[58] Field of Search ..... 440/66, 67, 71; 415/196, 197, 214; 416/189 R, 189 A, 189 B, 190, 191 R, 191 A

[56] References Cited

U.S. PATENT DOCUMENTS 3,367,116 2/1968 Stallman ..... 440/67

FOREIGN PATENT DOCUMENTS 2056257 5/1972 Fed. Rep. of Germany ..... 440/67
486956 12/1975 U.S.S.R. ..... 440/67
1202873 8/1970 United Kingdom ..... 440/67
1457881 12/1976 United Kingdom ..... 440/67

OTHER PUBLICATIONS

*Glass Reinforced Plastics,* Brian Parkyn 1970, pp. 16 and 227.

*Primary Examiner*—Joseph F. Peters, Jr.
*Assistant Examiner*—Jesûs D. Sotelo
*Attorney, Agent, or Firm*—Shlesinger & Myers

[57] ABSTRACT

A ship's propulsion duct surrounding a propeller is constructed with a main body of glass-reinforced synthetic plastics material, and at least the throat of the duct is protected from the erosive mechanical effects of flow breakdown at the tips of the propeller blades by force-absorbing resilient material. The resilient material may be an inset ring of elastomer, or a lining of elastomer secured over the whole inner surface of the duct, or a resilient coating applied to the duct surface by painting.

7 Claims, 1 Drawing Sheet

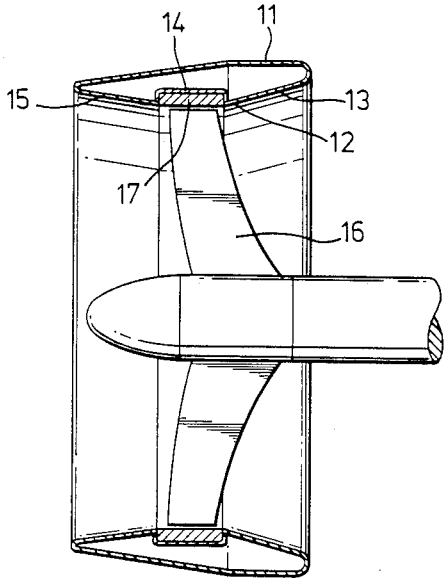
14
11
15
13
12
17
16

MARINE PROPULSION SYSTEM

This is a continuation of application Ser. No. 13,190, filed Feb. 9, 1987 abandoned; which is continued to Ser. No. 891,064 filed July 31, 1986 abandoned; which is continued to Ser. No. 771,166 filed Sept. 3, 1985 abandoned; which is continued to Ser. No. 595,609 filed Apr. 2, 1984 abandoned; which is continued to 498,862 filed May 27, 1983 abandoned; which is continued to 963,770 filed Nov. 27, 1978 abandoned.

This invention relates to marine propulsion systems.

It is well known that where propellers of vessels are heavily loaded it may well be advantageous to fit a propulsion duct, generally of accelerating type where the geometry of the duct produces an accelerated flow through the propeller. Such ducts may be fixed, with attached means of steering such as one or more rudders, or the duct itself may be rotating, say 35° port to 35° starboard, becoming, in effect, a rudder; or the duct and the propeller may be fixed together and the entire assembly rotated through 360° forming a rotatable propeller steering unit.

Such propulsion ducts are normally constructed of mild shipbuilding steel and, of course, are of a complex shape, being generally solids of revolution about the propeller axis but with quite complicated double curvature plating at the entry and, often, at the exit to the throat of the nozzle. Furthermore, the propeller blade tips operate very close to the throat of the duct or nozzle. This is essential to prevent development of tip vortices which reduce the thrust of the overall system.

It has been found that this proximity of the propeller blade tips to the throat of the duct produces undesirable effects, namely a degree of scour of the surface of the duct throat and, if there is any breakdown of flow, erosion of the paint from the surface of the duct by the water forces. The net result is that a large bronze object, the propeller, is then in close proximity to the bare mild steel of the throat of the duct from which the paint has been removed, and rapid corrosion and erosion can occur.

Thus, in high quality ducts and particularly ducts where the loading is high, it is known to fit a stainless steel insert in way of the propeller tips, this insert being a circumferential cylinder of stainless steel let into the surface of the duct and forming a shroud round the propeller blade tips.

The construction of a nozzle or duct in mild steel is quite expensive and is rendered more so by the necessity, in some cases, to fit this stainless steel shroud plate. The purpose of the stainless steel is not to withstand the erosion effects resulting from flow breakdown and cavitation of the propeller tips but to provide a surface which does not corrode either chemically or galvanically in the presence of the propeller blades when it is unpainted. Paint will be cleaned off such a surface; it is not necessay to paint a stainless steel shroud, whereas a painted mild steel shroud soon becomes an unpainted mild steel shroud, as explained above.

According to the present invention, there is provided a ship's propulsion duct to surround a propeller, wherein the main body of the duct is constructed of fibre-reinforced synthetic plastics material, and at least the inner surface of the throat of the duct, within which the propeller blades rotate, is formed of a resilient material fastened to the plastics main body and thick enough to absorb forces sufficiently to protect the duct from the erosive mechanical effects of flow breakdown at the tips of the blades of the propeller.

The duct may be constructed in the normal way that glass reinforced plastic mouldings are constructed, namely hand lay-up into a mould, preferably using glass cloth but alternatively using glass mat; and preferably using epoxy resins but alternatively using polyester resins. The duct may be of any suitable section shape, a preferred shape being one where the entry is formed, in effect, by a pipe ring with a cone as flare plate leading back to the cylindrical throat with a radius between the cone and the throat cylinder. However, any of the normal or proprietary duct shapes may be used for the construction of the duct in G.R.P., this being a matter of choice for the particular application.

Glass fibre reinforced plastic mouldings have a gel coat forming the surface. Generally, this gel coat is not resistant to abrasion, neither is it resistant to impact, especially repeated blows on a highly localised area. The reason is that the gel coat is brittle. If it is subjected to repeated blows at a particular point, it tends to craze and then flake off, leaving the basic moulding underneath exposed to the water. This, of course, is undesirable and can lead to rapid deterioration of the duct and general failure.

Apart from this, a glass fibre nozzle or duct is very suitable, generally, for marine application requiring no painting, being light, being easily constructed, being immune from corrosion and having no electrolytic or galvanic problems arising from the proximity of the propeller. Its major disadvantage, however, is the lack of resistance to repeated impact in a localised area.

Due to the breakdown or implosion of cavitation bubbles at the tips of the propeller blades, just this eventuality is particularly liable to occur in way of the tips of the propeller blades, and the duct, therefore, may suffer heavy damage quite quickly in the presence of a heavily loaded propeller. This damage would be in the form of a circumferential ring of erosion and mechanical damage in way of the propeller tips and in the throat.

When a cavitation bubble collapses or implodes, it may be considered, as a generalisation, as being a hermisphere, the diametric plane being in contact with the surface on to which the bubble is imploding. The collapse of the bubble produces a focussing effect rather like a shaped explosive charge and the net result is a very high localised pressure which will break down many materials.

If the material in question is brittle, and particularly if it has a high elastic modulus, its resistance to the forces of the implosion is large and high stresses develop locally in the material. If, however, the elastic modulus is very low, the material "gives" and the force is absorbed by the compression locally of the material on to which it is collapsing. An analogy is a boxer's punch bag where the soft bag absorbs the blow whereas a hard surface will produce little movement and hence a very large reacting force. The matter is calculable and is a simple question of the rate of absorption of momentum.

Arrangements according to the invention will now be described by way of example. Reference will be had to the accompanying drawing which shows, in longitudinal section, a duct and propeller assembly embodying the invention.

In the drawing, a duct 11 is constructed as a hollow fibre reinforced plastics lay-up, the internal wall 12 of which is formed with a conical entry flare 13, a cylindrical throat 14 and a conical exit 15. The propeller 16 in the duct rotates with the tips of its blades close to the inner periphery of the throat 14. The glass-fibre reinforced wall of the throat is recessed so as to allow the bonding-in, using waterproof resilient glue, of a resilient shroud plate or insert ring 17. This desirably may be of a synthetic elastomer material such as neoprene, although this particular type of material is not the only one possible. The insert which may, in a particular case, have a thickness of $\frac{1}{4}''$, but may be more or less than this thickness, is bonded into the recess so that the inner surface of the throat 14 of the duct is flush. In other words, the recess may be $\frac{1}{4}''$ in depth and the shroud plate material $\frac{1}{4}''$ in thickness.

It is important that the shroud plate or insert ring 17 should extend fore and aft in the duct sufficiently to cover the entire length of the throat surface that may be subjected to collapse of any cavitation resulting from the passage of the propeller tips, and generally the same length as in the case of stainless steel shroud plates will be sufficient although it is prudent to allow a margin above this.

In another embodiment of the invention, the entire inner surface of the duct, that is to say the entry flare 13, the throat 14 and the exit cone 15, are covered with bonded-on sheet rubber, neoprene or similar material. It is essential that this sheet should not be capable of lifting off the reinforced plastics surface under water loads and hence it is desirable that, at the entry to the nozzle and at the exit, a circumferential holding down ring strip be fitted on the nozzle over the edge of the elastomeric sheet, being secured on to the nozzle. This is similar to the strip fitted to the edge of a carpet on a floor to prevent the edge lifting. The strip, which may be of any suitable material, for example stainless steel, can be screwed to the duct by, for example, self-tapping screws or held by bolts.

The thickness of the covering of elastomeric material is desirably of the order of $\frac{1}{8}''$ (3 mm) but any other thickness that is suitable for the particular size of duct may, of course, be used.

In a further embodiment, the entire surface of the duct may be coated with a flexible rubber, neoprene, polyvinyl chloride or similar paint producing a uniform thickness of resilient material capable of absorbing the forces resulting from implosion of cavitation bubbles, etc.

In each embodiment, elastomeric material extends at least along a band disposed along the inner surface of said throat. The band, in the form of a ring 17 in one embodiment or an elastomeric coating in another embodiment, is thick enough to absorb the forces resulting from implosion of cavitation bubbles or the like—as discussed above. Similarly, the band extends fore and aft a length at least coextensive with the length along the throat of the surface that may be subjected to collapse of any cavitation. The band surrounds the propeller and is spaced from tips of the propeller blades when the propeller is assembled in the duct as shown in the FIGURE.

I claim:

1. A ship's propulsion duct for surrounding a propeller, the duct comprising:

a lightweight, hollow cylindrical throat that is constructed of glass fibre-reinforced synthetic plastic material which is subject to erosion by flow breakdown at the tips of a propeller surrounded by the duct and implosion of cavitation bubbles, and that has a gel coating; and at least a cylindrical band disposed along the inner surface of said throat being formed of elastomeric material; said elastomeric band surrounding and being spaced from the blades of the propeller during the rotation thereof; and said elastomeric band extending sufficiently fore and aft in the duct and being dimensioned to absorb forces to minimize the erosive mechanical effects of flow breakdown at the tips of the blades of the propeller and along the portion of the duct subjected to collapse of cavitation bubbles to provide an elastic absorbing surface which will prevent erosion by the implosion of cavitation bubbles.

2. A duct according to claim 1, wherein said band comprises a ring and wherein said throat of said duct is formed with a recess into which said ring is inset and bonded.

3. A duct according to claim 1, wherein said band comprises a painted coating of elastomeric material that forms a resilient coating.

4. A duct according to claim 1 wherein said duct has a convergent frustro-conical entry and a divergent frustro-conical exit with said throat positioned therebetween;

said duct, entry, and exit being coaxial.

5. A method of protecting a ship's propulsion duct that surrounds a propeller installable within the duct from the erosive mechanical effects of flow breakdown at the tips of the blades of the propeller, the method comprising the steps of:

forming a hollow duct of a fibre-reinforced synthetic plastic material; and disposing an elongated cylindrical band of elastomeric material along the inner surface of the duct dimensioned to extend circumferentially about, to be spaced from, and extend fore and aft of the propeller blades when the propeller is assembled in the duct;

attaching the duct to the ship in a manner to surround the propeller and to position the band proximate to the propeller so as to prevent mechanical contact of the propeller and the duct as well as to absorb mechanical forces resulting from flow breakdown at the tips of the propeller blades and from implosion of cavitation bubbles.

6. A method according to claim 5 wherein said band disposing step includes the further step of:

dimensioning the elastomeric band to extend the entire axial length of the duct.

7. A ship's propulsion duct for surrounding propeller, the duct comprising:

a cylindrical throat that is constructed of glass fibre-reinforced synthetic plastic material which is subject to erosion by flow breakdown at the tips of a propeller surrounded by the duct and implosion of cavitation bubbles, said throat having a gel coating; and a resilient coating being disposed along the inner surface of said throat surrounding and being so spaced in a cicumferential annulus proximate to the blades of the propeller so as to prevent contact between said blades and said coating during rotation thereof while maximizing flow efficiencies through the propulsion duct, and said resilient coating being composed of an elastic cavitation erosion resistant material to prevent erosion by implosion of cavitation bubbles said resilient coating being dimensioned to absorb forces sufficiently to protect the duct from the erosive mechanical effects of flow breakdown both at the tips of the blades of the propeller and the region of the duct subject to cavitation erosion.

* * * * *

UNITED STATES PATENT AND TRADEMARK OFFICE

CERTIFICATE OF CORRECTION

PATENT NO. : 4,832,633

DATED : May 23, 1989

INVENTOR(S) : Ewan C. B. Corlett

It is certified that error appears in the above-identified patent and that said Letters Patent is hereby corrected as shown below:

On Title page: Item [73[

Change the name of the Assignee from "Hydronic, Ltd." to --Hydroconic, Ltd.--.

Signed and Sealed this

Fourth Day of August, 1992

*Attest:*

DOUGLAS B. COMER

*Attesting Officer*

*Acting Commissioner of Patents and Trademarks*